US010625973B2

(12) United States Patent
Shearer

(10) Patent No.: US 10,625,973 B2
(45) Date of Patent: Apr. 21, 2020

(54) FILAMENT DISPENSING SYSTEM

(71) Applicant: Pamela Ann Shearer, Itasca, IL (US)

(72) Inventor: Pamela Ann Shearer, Itasca, IL (US)

( * ) Notice: Subject to any disclaimer, the term of this patent is extended or adjusted under 35 U.S.C. 154(b) by 0 days.

(21) Appl. No.: 16/139,790

(22) Filed: Sep. 24, 2018

(65) Prior Publication Data

US 2020/0095086 A1 Mar. 26, 2020

(51) Int. Cl.

| | |
|---|---|
| ***B65H 49/20*** | (2006.01) |
| ***D05C 1/06*** | (2006.01) |
| ***B65H 75/16*** | (2006.01) |
| ***B65H 75/32*** | (2006.01) |
| ***B65H 75/14*** | (2006.01) |

(52) U.S. Cl.

CPC ..... *B65H 49/205* (2013.01); *B65H 75/16* (2013.01); *D05C 1/065* (2013.01); *B65H 75/14* (2013.01); *B65H 75/32* (2013.01); *B65H 2403/47* (2013.01); *B65H 2701/31* (2013.01)

(58) Field of Classification Search

CPC ..... B65H 75/16; B65H 75/32; B65H 49/205; B65H 2701/31; D04B 3/06; D05C 1/00; D05C 1/065; D05B 91/16

USPC ..... 242/588.3

See application file for complete search history.

(56) References Cited

U.S. PATENT DOCUMENTS

| | | | | |
|---|---|---|---|---|
| 1,836,593 | A | 12/1931 | Herbert et al. | |
| 2,029,975 | A | 2/1936 | Douglas et al. | |
| 2,790,609 | A | 4/1957 | Hawthorne et al. | |
| 2,894,620 | A | 7/1959 | Campbell et al. | |
| 3,313,498 | A * | 4/1967 | Wasson | B65H 49/205 242/395.1 |
| 3,602,455 | A | 8/1971 | Lewis et al. | |
| 3,907,228 | A | 9/1975 | Lewis | |
| 4,111,089 | A * | 9/1978 | Montaruli | B65H 49/205 225/45 |
| 4,475,652 | A | 10/1984 | Heard | |
| 5,992,787 | A | 11/1999 | Burke | |
| 6,554,218 | B2 | 4/2003 | Buyce et al. | |
| 7,051,894 | B2 | 5/2006 | Barnes et al. | |
| 7,207,739 | B1 | 4/2007 | Preteroti | |
| 8,020,802 | B2 * | 9/2011 | Iacona | B65D 85/04 242/153 |
| 8,230,995 | B2 | 7/2012 | Andrews et al. | |
| 8,235,323 | B2 | 8/2012 | Newton, Jr. | |
| 8,584,840 | B2 | 11/2013 | Kim | |
| 9,061,854 | B2 * | 6/2015 | Wells | B65H 16/005 |
| 2003/0132339 | A1 * | 7/2003 | McCarthy | B65H 49/08 242/588.1 |
| 2011/0168746 | A1 | 7/2011 | Kamiyama | |

(Continued)

*Primary Examiner* — William E Dondero

(74) *Attorney, Agent, or Firm* — Dunlap Bennett & Ludwig PLLC

(57) ABSTRACT

A filament dispensing system is provided. The filament dispensing system embodies one or more donut shaped filament dispensers interconnectable by a band. Each dispenser is transparent and provides an integrated cutter. The transparency enables visual identification of the color of filament with the transparent dispenser, while the integrated cutter makes scissors unnecessary. The donut-shaped structure of the dispenser enables an operative association with the band that can decoratively hang from a user's neck during use. The filament dispensing system may also include a bobbin rethreader.

9 Claims, 3 Drawing Sheets

(56) References Cited

U.S. PATENT DOCUMENTS

| | | | | |
|---|---|---|---|---|
| 2013/0140396 | A1* | 6/2013 | Gupta | B65H 75/30<br>242/416 |
| 2015/0307312 | A1 | 10/2015 | Finck | |
| 2018/0112338 | A1 | 4/2018 | Sullivan | |

* cited by examiner

FILAMENT DISPENSING SYSTEM

BACKGROUND OF THE INVENTION

The present invention relates to filament dispensers and, more particularly, to one or more transparent dispensers for embroidery thread with an integrated cutter, wherein each transparent dispenser may be engaged by a loop so as to be worn by a user.

Embroidery is the art of working raised and ornamental designs in a plurality of threads (or "filaments"), upon any woven fabric, leather, paper, etc., with a needle. Currently there is no system for keeping a plurality of dispensers (each with a different color thread or filament) them organized, free of knotting, and associated with an integrated cutter. Rather, such threading is normally kept in a disorganized thread box.

As can be seen, there is a need for a transparent dispenser for embroidery thread with an integrated cutter, wherein scissors are unnecessary, and wherein the dispenser is adapted to make the embroidery thread accessible and organized. The transparency enables visual identification of each color of the plurality of embroidery thread, while the donut-shaped dispenser provides structure to hang from a user's neck so that all the colors are at the ready on a decorative necklace. As a result, such a neat and tidy embroidery thread dispenser system can be conveniently taken and used or anywhere.

SUMMARY OF THE INVENTION

In one aspect of the present invention, a filament dispenser includes a first body portion made of transparent or translucent material, the first body portion defining a first hole portion; a second body portion made of transparent or translucent material, the second body portion defining a second hole portion; a pivotal connection operatively associated with the first and second body portions so that said body portions are movable between an open configuration and a closed configuration defining a hollow body dimensioned to house a bobbin spool; a through hole defined by the first and second hole portions in the closed configuration; a filament passage disposed along a circumferential surface of the closed configuration, the filament passage communicating with the hollow body; and a blade provided adjacent the filament passage.

In another aspect of the present invention, the filament dispenser includes a first body portion made of transparent or translucent material, the first body portion defining a first hole portion; a second body portion made of transparent or translucent material, the second body portion defining a second hole portion; a pivotal connection operatively associated with the first and second body portions so that said body portions are movable between an open configuration and a closed configuration defining a hollow body dimensioned to house a bobbin spool, wherein the closed configuration defines a donut shape, wherein the open configuration provides greater access to the hollow body; a through hole defined by the first and second hole portions forming a nested position in the closed configuration; a filament passage disposed along a circumferential surface of the closed configuration, the filament passage communicating with the hollow body; a blade provided adjacent, within, external to, or besides the filament passage; and a needle clip disposed along an outward facing surface of either the first or second body portion.

In yet another aspect of the present invention, a filament dispensing system includes one or more of the above-mentioned filament dispensers and a band slidably received through the through hole of each filament dispenser.

These and other features, aspects and advantages of the present invention will become better understood with reference to the following drawings, description and claims.

DETAILED DESCRIPTION OF THE INVENTION

Figure 1:
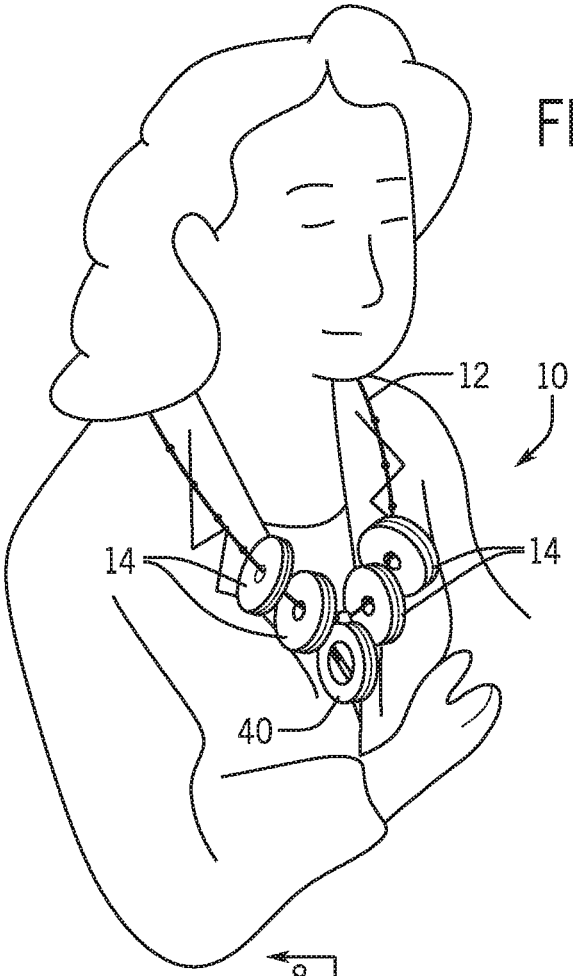
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a filament dispensing system embodying one or more donut shaped filament dispensers interconnectable by a band. Each dispenser is transparent and provides an integrated cutter. The transparency enables visual identification of the color of filament with the transparent dispenser. The donut-shaped structure of the dispenser enables an operative association with the band that can decoratively hang from a user's neck during use. The filament dispensing system may also include a bobbin rethreader.

Referring to FIGS. 1 through 9, the present invention may include a filament dispensing system 10 embodying one or more donut shaped filament dispensers 14 interconnected by a band 12 for retaining the one or more filament dispensers 14 about an object, such as a user's neck during use or a hook for storage. The filament 38 may be thread, like embroidery thread, various fibers, or the like.

Figure 5:
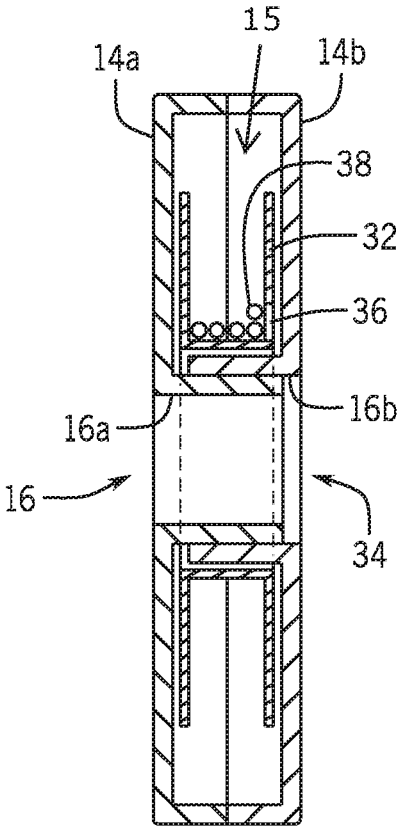
FIG. 5 is a cross-sectional view of the donut thread dispenser in a closed configuration an exemplary embodiment of the present invention, taken along line 5-5 in FIG. 2.
Figure 6:
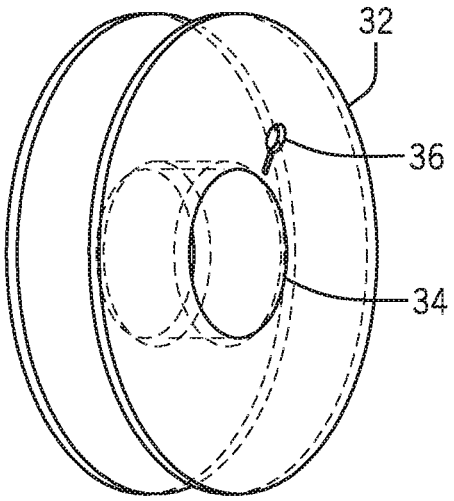
FIG. 6 is a perspective view of a typical bobbin or spool 32 of an exemplary embodiment of the present invention.
Figure 7:
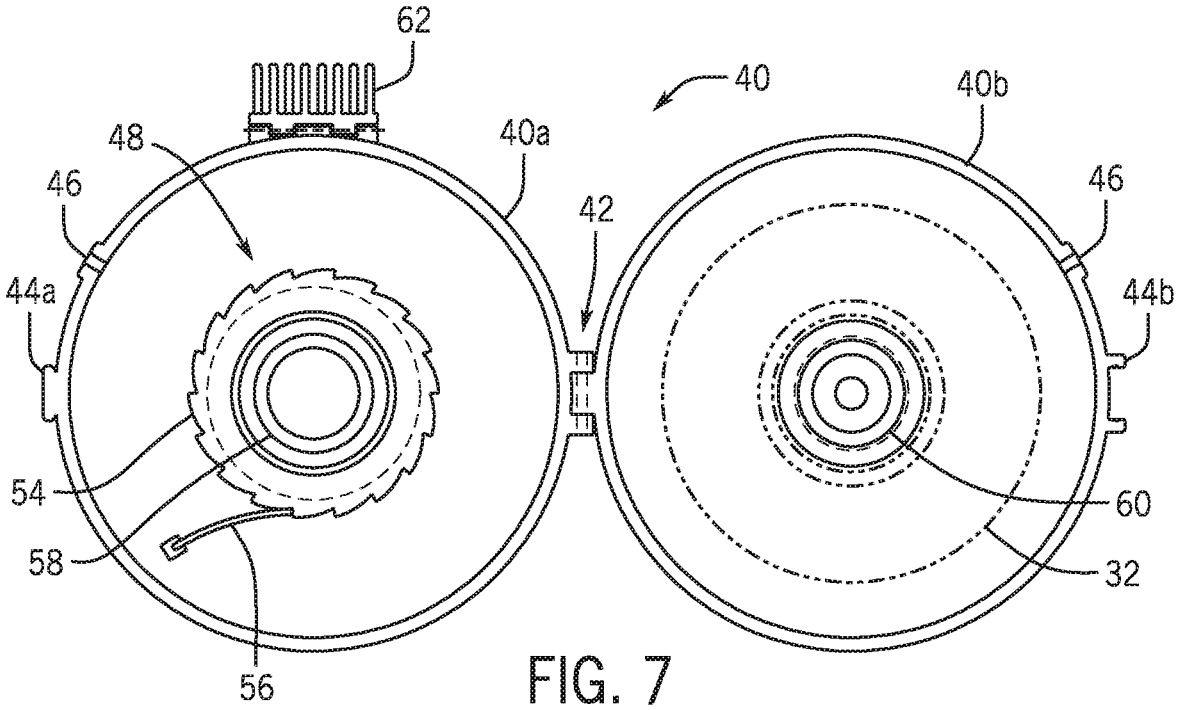
FIG. 7 is a front view of the donut bobbin rethreader shown in an open condition of an exemplary embodiment of the present invention.
Figure 8:
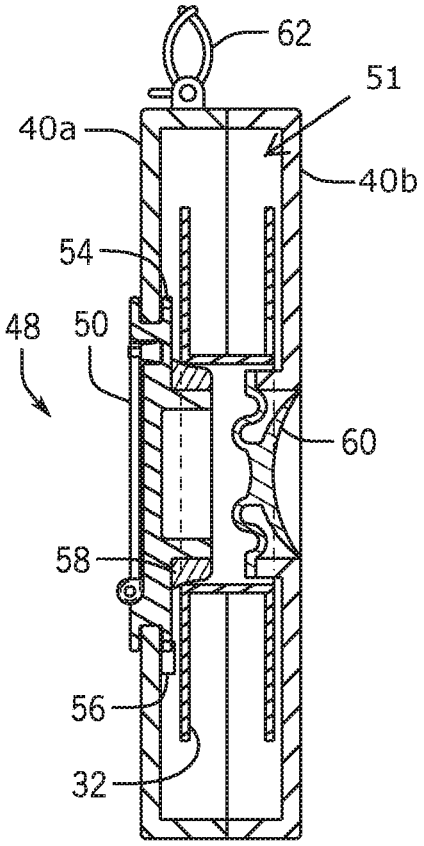
FIG. 8 is a cross-sectional view of an exemplary embodiment of the present invention, taken along line 8-8 in FIG. 3, illustrating the bobbin rethreader in a closed condition wherein the lobster claw 62 is in an engaged position and a suction mechanism 60 in a retracted position.
Figure 9:
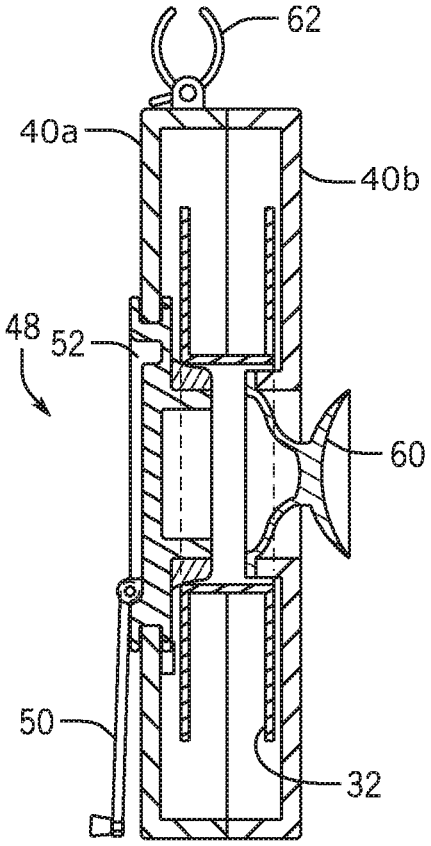
FIG. 9 is a cross-sectional view of FIG. 8, but illustrating the lobster claw 62 in a disengaged position and the suction mechanism 60 in an extended position.

Each filament dispenser 14 may define a first body portion 14*a* and a second body portion 14*b* pivotally connected by a pivotal connection 18, such as a hinge, so that they are movable between an open configuration and a closed configuration defining a hollow donut shape having a body through hole 16 passing through the filament dispenser 14. Each body portion 14*a* and 14*b* may be provide a first hole portion 16*a* and a second hole portion 16*b*, respectively, that engage each other in the closed configuration to form the body through hole 16, as illustrated in FIG. 5. Such engagement may include the first hole portion 16*a* nesting within the second hole portion 16*b*.

Figure 2:
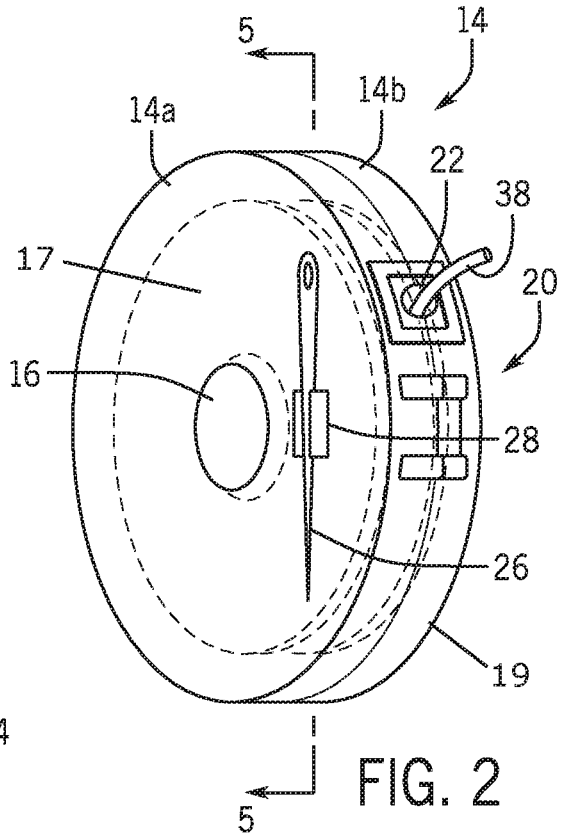
FIG. 2 is a perspective view of a donut thread dispenser of an exemplary embodiment of the present invention.
Figure 3:
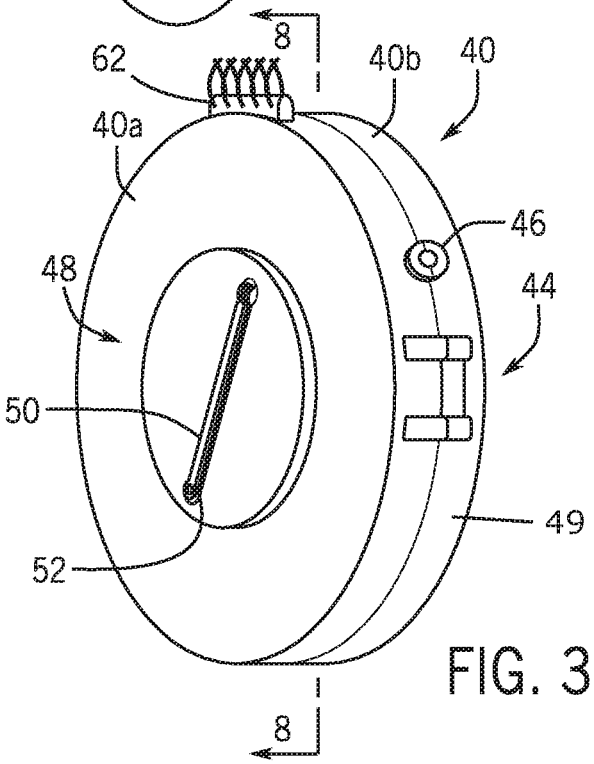
FIG. 3 is a perspective view of a donut bobbin rethreader of an exemplary embodiment of the present invention.
Figure 4:
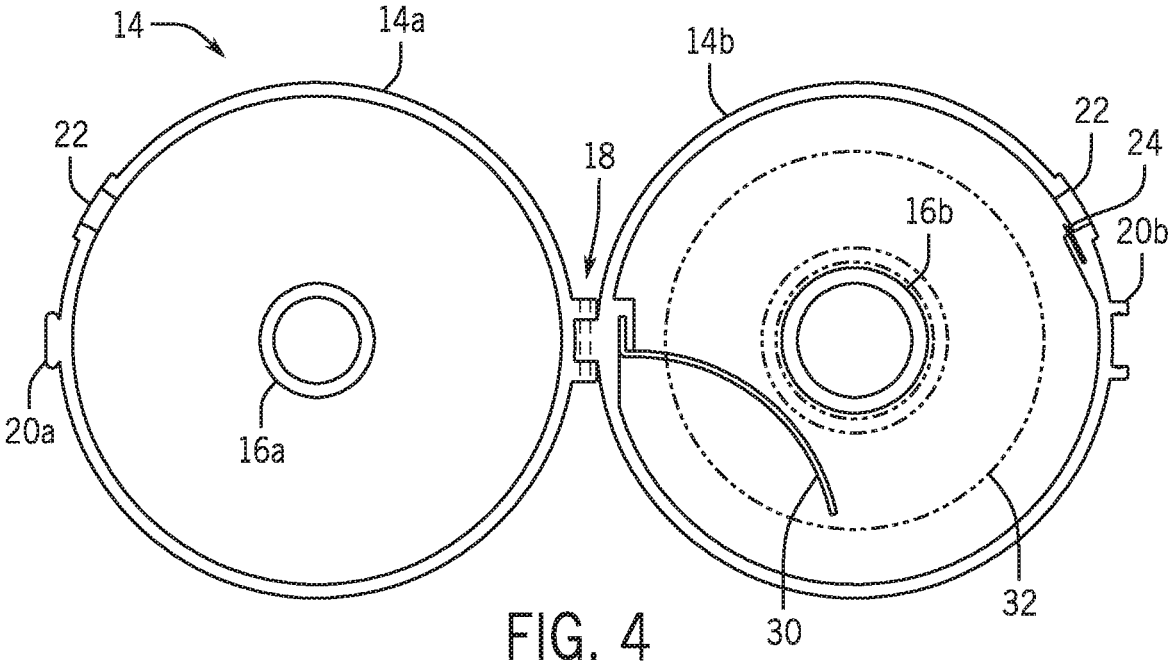
FIG. 4 is a front view of the donut thread dispenser in an open configuration of an exemplary embodiment of the present invention.

Along an outer side surface of the body portions 14*a* and 14*b* may be a needle clip 28 for slidably receiving and removably storing a needle 26, as illustrated in FIG. 2. Along an outer portion of the circumferential surface 19 may be provided a clasp mechanism 20. The clasp mechanism 20 may include a first clasp portion 20*a* along a portion of the first body portion 14*a* and a second clasp portion 20*b* along a portion of the second body portion 14*b* so that in the closed configuration the clasp mechanism 20 is in a locked engagement. The circumferential surface 19 may also provide a filament passage 22 communicating to a hollow body portion 15 wherein filament 38 may pass through. The open configuration is adapted to access the hollow body portion 15. The filament passage 22 may be formed when the filament dispenser 14 is in the closed configuration as a first and second portion of the filament passage 22 may be on the first and second body portions 14*a* and 14*b*, respectively. Along the void defined by the filament passage 22 or adjacent thereto may be provided a blade 24 so that filament 38 passing through the filament passage 22 may be severed by the blade 24 through manipulation of the filament 38. In some embodiments, the filament passage 22 may have the silicone donut insert to prevent the filament 38 from traveling back into the hollow body portion 15, and so preventing the filament 38 from flowing out of the filament passage 22 too quickly.

Each body portion 14*a* and 14*b* may be made of transparent or translucent material so as to enable visually inspection contents or at least the colors of the contents within the hollow body portion 15 and opening allows insertion and removal of the bobbin/spool 32. Accordingly, a bobbin or spool 32 may be dimensioned and adapted to operatively associate with the hollow body portion 15, including a spool hole 34 that aligns with the body through hole 16. One of the body portions 14*a* or 14*b* may provide a spool tension member 30 dimensioned and adapted to operatively associate with the spool 32 in the hollow body portion 15. The spool 32 may provide a thread anchor slot 36 so that when filament 38 is wrapped around the hub of the spool 32, the filament 38 may be anchored to the spool 32.

Referring the FIGS. 3, 7-9, the present invention may include a bobbin rethreader 40. The bobbin rethreader 40 may include a first bobbin portion 40*a* and a second bobbin portion 40*b* pivotally connected by a pivotal connection 42, such as a hinge, so that they are movable between an open condition and a closed condition.

Along an outer portion of the circumferential surface 49 of the bobbin rethreader 40 may be provided a bobbin clasp mechanism 44. The bobbin clasp mechanism 44 may include a first bobbin clasp portion 44*a* along a portion of the first bobbin portion 44*a* and a second bobbin clasp portion 44*b* along a portion of the second bobbin portion 44*b* so that in the closed condition the clasp mechanism 44 is in a locked engagement. The circumferential surface 49 may also provide a lobster claw 62 movable between an engaged position and a disengaged position. The circumferential surface 49 may also provide a thread tensioner 46 communicating to a hollow bobbin portion 51. The thread tensioner 46 may be formed when the bobbin rethreader 40 is in the closed condition as a first and second portion of the bobbin rethreader 40 may be on the first and second bobbin portions 40*a* and 40*b*, respectively. The spool 32 may be dimensioned and adapted to operatively associate with the hollow bobbin portion 51.

An outward facing surface of the first bobbin portion 40*a* may be provide a rewind unit 48 with a rewind handle 50 that may be adapted to nest into a storage pocket 52. Within the hollow bobbin portion 51 a ratchet 54, ratchet detent 56, and rubber cone 58 may be operatively associated with the rewind unit 48. An outward facing surface of the second bobbin portion 40*b* may be provide a suction mechanism 60 (such as a suction cup) movable between a retracted position and an extended position.

A method of using the present invention may include the following. The filament dispensing system 10 disclosed above. A user may string the band 12 (or necklace) through the through hole 16 of one or more filament dispenser 14. Each filament dispenser 14 may operatively store a different color of filament 38, keeping all of their colors right in front of the use as they utilize the filament 38, such as when embroidering. The user need not employ a scissors because of each blade 24, making the present invention convenient for traveling. In certain embodiments, the band 12 may connect to the bobbin rethreader 40, in certain embodiments, by the lobster claw 62.

It should be understood, of course, that the foregoing relates to exemplary embodiments of the invention and that modifications may be made without departing from the spirit and scope of the invention as set forth in the following claims.

What is claimed is:

1. A filament dispensing system comprising:

one or more filament dispensers, each filament dispenser comprising:

a first body portion made of transparent or translucent material, the first body portion defining a first hole portion;

a second body portion made of transparent or translucent material, the second body portion defining a second hole portion;

a pivotal connection operatively associated with the first and second body portions so that said body portions are movable between an open configuration and a closed configuration defining a hollow body dimensioned to house a bobbin spool;

a through hole defined by the first and second hole portions in the closed configuration;

a filament passage disposed along a circumferential surface of the closed configuration, the filament passage communicating with the hollow body; and a blade provided within the filament passage; and a band slidably received through the through hole of each filament dispenser.

2. The filament dispenser system of claim 1, wherein the closed configuration defines a donut shape.

3. The filament dispenser system of claim 1, wherein the open configuration provides greater access to the hollow body dimensioned for bobbin insertion and removal.

4. The filament dispenser system of claim 1, further comprising a needle clip disposed along an outward facing surface of either the first or second body portion.

5. The filament dispenser system of claim 1, wherein the first and second hole portions form a nested position in the closed configuration.

6. The filament dispensing system of claim 1, further comprising a bobbin rethreader operatively associated with the band.

7. The filament dispensing system of claim 6, wherein the bobbin rethreader further comprises a suction mechanism along an outward face side of the bobbin rethreader, wherein the suction mechanism is movable between a retracted position and an extended position.

8. The filament dispensing system of claim 6, wherein the bobbin rethreader comprises a ratchet, a ratchet detent, a spool tension member, and a rewind unit operatively associated with the bobbin spool.

9. A filament dispensing system comprising:

one or more filament dispensers, each filament dispenser comprising:

a first body portion made of transparent or translucent material, the first body portion defining a first hole portion;

a second body portion made of transparent or translucent material, the second body portion defining a second hole portion;

a pivotal connection operatively associated with the first and second body portions so that said body portions are movable between an open configuration and a closed configuration defining a hollow body dimensioned to house a bobbin spool, wherein the closed configuration defines a donut shape, wherein the open configuration provides greater access to the hollow body;

a through hole defined by the first and second hole portions forming a nested position in the closed configuration;

a filament passage disposed along a circumferential surface of the closed configuration, the filament passage communicating with the hollow body;

a blade provided adjacent to the filament passage; and a needle clip disposed along an outward facing surface of either the first or second body portion; and a band slidably received through the through hole of each filament dispenser.

* * * * *